United States Patent [19]

Mowbray

[11] Patent Number: 4,575,316

[45] Date of Patent: Mar. 11, 1986

[54] ROTARY DISTRIBUTOR PUMP

[75] Inventor: Dorian F. Mowbray, Burnham, England

[73] Assignee: Lucas Industries public limited company, Birmingham, England

[21] Appl. No.: 717,006

[22] Filed: Mar. 28, 1985

[30] Foreign Application Priority Data

Apr. 19, 1984 [GB] United Kingdom ..... 8410280

[51] Int. Cl.[4] ..... F04B 19/00; F04B 29/00

[52] U.S. Cl. ..... 417/462; 123/450

[58] Field of Search ..... 417/460, 462; 123/450

[56] References Cited

U.S. PATENT DOCUMENTS 4,474,157 10/1984 Skinner et al. ..... 417/462

4,486,154 12/1984 Duplat ..... 417/462

4,499,883 2/1985 Miyaki et al. ..... 123/450

FOREIGN PATENT DOCUMENTS 2073331 10/1981 United Kingdom ..... 123/450

*Primary Examiner*—William L. Freeh

[57] ABSTRACT

A rotary distributor pump has a radial bore mounting a pumping plunger at the outer end of which is a shoe carrying a captive roller engageable with the internal surface of a cam ring. The plungers are coupled to the shoes by a clip and further cam surfaces are provided engageable by the outer ends of the rollers. The plungers can therefore be positively reciprocated within the bore.

5 Claims, 5 Drawing Figures

ROTARY DISTRIBUTOR PUMP

This invention relates to rotary distributor type fuel injection pumps of the kind comprising a rotary distributor member housed in a body and arranged in use to be driven in timed relationship with an associated engine, a radial bore in the distributor member and a plunger located therein, an annular cam in the body, the cam having an internal cam surface defining an inwardly directed cam lobe or cam lobes for imparting inward movement to the pumping plunger as the distributor member rotates and passage means through which fuel can escape from the bore to a pump outlet and through which fuel can flow to the bore from a source of fuel.

Most practical versions of pumps of the aforesaid type do not have any mechanical arrangement for driving the plunger outwardly following inward movement by a cam lobe. However, pumps of this type have been illustrated in which a compression spring housed within the bore, is utilised to return the plunger but in practice it is found that the life of the spring is limited because of the high stress to which it is subjected. Centrifugal force which acts to urge the plunger outwardly, is low particularly at engine cranking speeds and as a result the pump is unable to draw fuel from for example a supply tank. It has therefore been necessary to provide a low pressure pump for this purpose and usually the low pressure pump is housed in the same body.

The object of the present invention is to provide a pump of the aforesaid kind in a simple and convenient form.

According to the invention a rotary distributor pump of the kind specified comprises a cam follower positioned at the outer end of the plunger, said cam follower comprising a shoe and a captive roller carried by the shoe for engagement with the cam surface of the cam ring, said roller extending at its opposite ends beyond the shoe, clip means retaining the shoe to the outer end of the plunger, and a pair of cam members positioned on opposite sides of said cam ring, said cam members defining cam surfaces engageable by the extended portions of said roller respectively, said cam surfaces facing the cam surface defined by the cam ring and acting to urge the cam follower and plunger outwardly following inward movement by the cam lobe or lobes.

An example of a rotary distributor type fuel injection pump will now be described with reference to the accompanying drawings in which.

Figures 1, 2, 3, 4, 5:
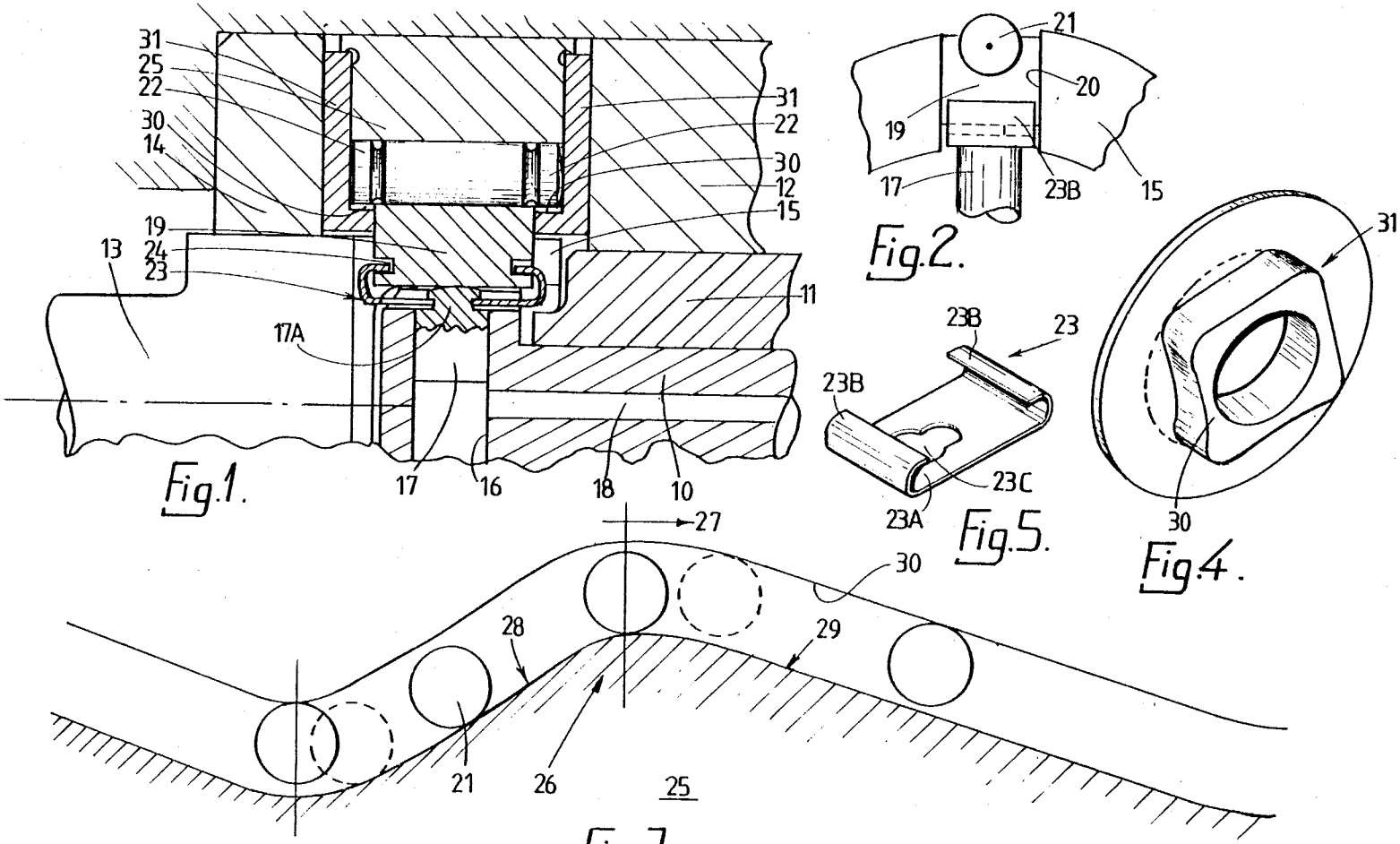
FIG. 1 is a part sectional side elevation of a portion of the pump.
FIG. 2 is an end view of part of the pump seen in FIG. 1.
FIG. 3 is a developed view of the cam surfaces defined by parts of the pump seen in FIG. 1.
FIG. 4 is a perspective view of part of the pump shown in FIG. 1.
FIG. 5 is a perspective view of a further part of the pump shown in FIG. 1.

Referring to the drawings the injection pump comprises a rotary cylindrical distributor member 10 which is housed within a sleeve 11 mounted in a body 12. The distributor member is coupled to a drive shaft 13 which is supported in a bearing 14 and conveniently a tongue and groove connection is provided between the distributor member and drive shaft. The drive shaft in use is driven in timed relationship with an associated engine and it defines an enlarged annular portion 15 which surrounds the distributor member.

Formed in the distributor member is a radial bore 16 in which is mounted a pair of pumping plungers 17 only one of which is illustrated. The bore 16 communicates with a longitudinal passage 18 in the distributor member and this passage can communicate in turn, with outlet and inlet ports formed in the sleeve 11 whereby fuel can flow from the bore 16 during inward movement of the plungers and whereby fuel can flow to the bore 16 during outward movement of the plungers as will be described. The aforesaid outlets in use will be connected to the fuel injection nozzles respectively of an associated engine while the aforesaid inlet ports will be connected to a fuel inlet in the body which in use is connected to a fuel tank.

Associated with each plunger is a cam follower which comprises a shoe 19 slidable as shown more clearly in FIG. 2, within a slot 20 defined in the enlarged portion 15 of the drive shaft. The shoe mounts a roller 21 and the roller is captive within the shoe by virtue of the fact that the cylindrical recess in the shoe 19 extends through more than 180°. As shown in FIG. 1, the roller extends beyond the ends of the shoe to define end portions 22.

The shoe 19 is coupled to the plunger by a spring clip 23 which as shown in FIG. 5, is formed from strip material and has an elongated base portion 23A having U shaped end portions 23B. The free ends of the end portions 23B locate within grooves 24 formed in the end surfaces of the follower 19. The plunger is provided with a slotted head 17A which can be located in the narrower portion of a keyhole shaped slot 23C formed in the base portion 23A of the clip 23, the engagement of the plunger and clip being achieved by pressing the head 17A through the wider portion of the slot 23C and then moving the clip in a lateral direction relative to the plunger. The clip is located in position by the side walls of the slots 20.

The rollers 21 engage the internal peripheral surface of an annular cam ring 25 which is located in the body. The internal peripheral surface or cam surface is provided with a series of equiangularly spaced cam lobes 26 which are shown in the developed view of FIG. 3. The rollers move relative to the cam surface in the direction of the arrow 27 and each cam lobe defines a leading flank 28 and a trailing flank 29.

When the roller is in engagement with the leading flank 28, it is being moved inwardly with the result that similar movement is imparted to the pumping plunger 17 and fuel will be displaced from the bore 16.

In order to effect outward movement of the plunger the end portions 22 of the roller engage further cam surfaces 30 defined by cam members 31 positioned on opposite sides of the cam ring 25. As will be seen from FIG. 1, each cam member 31 is of "L" cross-section and is of annular form. The cam surfaces 30 are formed on the short limbs of the members and face the cam surface formed on the cam ring. Each cam member defines in conjunction with the cam ring 25, a slot into which the respective end portion of the roller extends. The cam surfaces 30 are shaped in a manner complementary to the internal surface of the cam ring 25 but the aforesaid slot is slightly wider than the diameter of the roller. This is to permit the roller to roll properly in its shoe. As will be seen from FIG. 3 when the roller has passed over the crest of the cam lobe it moves away from the trailing flank 29 of the cam lobe into contact with the cam surface 30 and as it follows this surface it will be moved outwardly thereby drawing fuel into the bore 16.

It will be appreciated that the plungers 17 have a fixed stroke and control of the amount of fuel supplied by the pump to the associated engine is effected by allowing spillage of fuel. This may be achieved by means of an electromagnetically operated spill valve or by using other known methods of spilling fuel, for example a sleeve slidable on the distributor member.

The apparatus illustrated in the drawings is for supplying fuel to a four cylinder engine and it will be seen that the leading flank 28 of the cam lobe extends over approximately 30° while the trailing flank of the cam lobe extends over approximately 60°. The period allowed for filling the bore in this example, is therefore twice as long as for the delivery of fuel which means that the rate of movement of the plunger during the flow of fuel to the bore is less than that which occurs when fuel is delivered from the bore.

By shaping the cam surfaces 30, particularly in the region towards the end of the trailing flank 29 of the cam lobe, the position at which the roller engages the leading flank 28 of the cam lobe and hence the instant at which inward movement of the plunger takes place, can be altered to obtain the desired initial rate of injection of fuel.

I claim:

1. A rotary distributor type fuel injection pump comprising a rotary distributor member housed in a body and arranged in use to be driven in timed relationship with an associated engine, a radial bore in the distributor member and plunger located therein, an annular cam in the body, the cam having an internal cam surface defining an inwardly directed cam lobe or cam lobes for imparting inward movement to the pumping plunger as the distributor member rotates, passage means through which fuel can escape from the bore to a pump outlet and through which fuel can flow to the bore from a source of fuel, a cam follower positioned at the outer end of the plunger, said cam follower comprising a shoe and a captive roller carried by the shoe for engagement with the cam surface of the cam ring, said roller extending at its opposite ends beyond the shoe, clip means retaining the shoe to the outer end of the plunger, and a pair of cam members positioned on opposite sides of said cam ring, said cam members defining cam surfaces engageable by the extended portions of said roller respectively, said cam surfaces facing the cam surface defined by the cam ring and acting to urge the cam follower and plunger outwardly following inward movement by the cam lobe or lobes.

2. A pump according to claim 1 in which said cam members are of "L" section, the shorter limbs of the cam members defining the cam surfaces.

3. A pump according to claim 1 in which said clip means is formed from strip material having an elongated base portion and U shaped end portions, slots in the follower to receive the free ends of said end portions, said base portion defining a slot engaged with a slotted head on the plunger.

4. A pump according to claim 3 in which said slot is of keyhole shape.

5. A pump according to claim 3 including a drive shaft coupled to the distributor member, said drive shaft including an enlarged portion surrounding the distributor member, a radial slot formed in said enlarged portion, said shoe being located in said slot and said clip being located by the side walls of said slot.

* * * * *